US008909090B2

(12) United States Patent
Ueno

(10) Patent No.: US 8,909,090 B2
(45) Date of Patent: Dec. 9, 2014

(54) CHARGING DEVICE

(71) Applicant: Canon Kabushiki Kaisha, Tokyo (JP)

(72) Inventor: Takashi Ueno, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/647,158

(22) Filed: Oct. 8, 2012

(65) Prior Publication Data

US 2013/0094878 A1 Apr. 18, 2013

(30) Foreign Application Priority Data

Oct. 12, 2011 (JP) ..... 2011-224936

(51) Int. Cl.
*G03G 15/02* (2006.01)

(52) U.S. Cl.
CPC ..... *G03G 15/0258* (2013.01); *G03G 15/0291* (2013.01)
USPC ..... 399/100

(58) Field of Classification Search
CPC ..... G03G 15/0291; G03G 15/0275
USPC ..... 399/100
See application file for complete search history.

(56) References Cited

U.S. PATENT DOCUMENTS 5,485,251 A * 1/1996 Kita et al. ..... 399/343
2011/0222897 A1* 9/2011 Makino ..... 399/92

FOREIGN PATENT DOCUMENTS

JP 3347885 B2 11/2002
JP 2005-338797 A 12/2005
JP 2006091456 A * 4/2006
JP 2006-301384 A 11/2006
JP 2007-072212 A 3/2007
JP 2011-186227 A 9/2011
JP 2012088421 A * 5/2012

* cited by examiner

*Primary Examiner* — Clayton E LaBalle
*Assistant Examiner* — Leon W Rhodes, Jr.
(74) *Attorney, Agent, or Firm* — Canon USA Inc. IP Division

(57) ABSTRACT

A charging device includes a corona charger including a grid electrode, a cleaning member configured to clean the grid electrode, a sheet-type shutter configured to open/close an opening of the corona charger, and a drive source configured to drive both the cleaning member and the shutter in a longitudinal direction of the corona charger, wherein the cleaning member is provided such that a cleaning ability thereof is higher in a case where the cleaning member and the shutter are moved in a closing direction of the opening of the corona charger than in a case where the cleaning member and the shutter are moved in an opening direction of the opening of the corona charger.

3 Claims, 10 Drawing Sheets

CHARGING DEVICE

BACKGROUND OF THE INVENTION

1. Field of the Invention

The present invention relates to a charging device including a cleaning member configured to clean a grid electrode and a shutter configured to open/close an opening of a corona charger.

2. Description of the Related Art

Conventionally, there are known image forming apparatuses employing an electrophotographic method and using a corona charger in a charging process. Some corona chargers of such image forming apparatuses are known to have a grid electrode provided at an opening portion of a shield thereof to stabilize electric potential of a photosensitive member.

However, foreign matters, such as airborne toner particles, tend to accumulate on the discharge side of the grid electrode. When such foreign matters locally accumulate on the inner surface of the grid electrode, defective charging tends to occur at the portion corresponding to where the foreign matters have accumulated.

Japanese Patent Application Laid-Open No. 2005-338797 discusses a configuration that prevents foreign matters from accumulating locally on the grid electrode by providing a cleaning unit that cleans the inner surface (discharge wire side) of the grid electrode. To be more precise, while a cleaning brush as a cleaning member is in contact with the inner surface of the grid electrode, the cleaning brush is driven in the longitudinal direction of the grid electrode. In this manner, the inner surface of the grid electrode is cleaned.

The corona charger is known to generate corona products such as ozone (O3) and nitrogen oxide (NOX) when charging the photosensitive member.

When the corona products are attached to the photosensitive member, and the attached corona products absorb moisture, the surface resistance of a portion to which the corona products have attached is reduced. Under the condition where the corona products having absorbed moisture are attached to the photosensitive member, an electrostatic latent image which corresponds to the image information cannot be accurately formed, and a defective image called "image deletion" is generated.

To solve such a problem, Japanese Patent Application Laid-Open No. 2007-072212 discusses a configuration that includes a shutter for covering an opening of a corona charger, so that the occurrence of the image deletion is reduced.

In a state where the image formation is not performed (e.g., at nighttime or when the main body is powered off), the opening of the corona charger is covered. Before the image forming is performed, the closed shutter is opened. The user generally desires quick start-up of the image forming apparatus, thus requiring enhancement of the shutter-opening speed.

In the configuration where both the shutter and a grid cleaning member are driven in the longitudinal direction of the corona charger, it is desirable to use one drive source (motor) for driving both the shutter and the grid cleaning member, from the viewpoint of cost reduction.

However, in the configuration where one drive source is shared, when the shutter is quickly opened to reduce the start-up time, the moving speed of the cleaning member, which cleans the grid electrode, also increases. If a cleaning brush is used as the cleaning member, the fiber of the cleaning brush may be caught in the grid electrode when the cleaning brush moves quickly. In such a case, the fiber may be torn and fall off from the cleaning brush. Further, if the grid electrode is cleaned by a cleaning pad, the cleaning pad may wear out easily.

As described above, if the cleaning member is driven quickly and wears out, the cleaning of the grid electrode may not be performed to a satisfactory extent. As a result, the defective charging can be caused.

SUMMARY OF THE INVENTION

The present invention is directed to a charging device, in a configuration where a cleaning member and a shutter are driven by a common motor, capable of preventing the cleaning member from wearing out, while reducing downtime.

According to an aspect of the present invention, a charging device includes a corona charger including a grid electrode, a cleaning member configured to clean the grid electrode, a sheet-type shutter configured to open/close an opening of the corona charger, and a drive source configured to drive both the cleaning member and the shutter in a longitudinal direction of the corona charger, wherein the cleaning member is provided such that a cleaning ability thereof is higher in a case where the cleaning member and the shutter are moved in a closing direction of the opening of the corona charger than in a case where the cleaning member and the shutter are moved in an opening direction of the opening of the corona charger.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Dimensions, materials, and shapes of the components of the embodiments, and relative arrangements thereof can be changed as appropriate according to the configuration and various conditions of the apparatus to which the present invention is applied, and the scope shall not be construed as limited to the embodiments described below.

After an outline of an image forming apparatus according to the present invention is described, a configuration of a corona charger will be described in detail.

Figure 1:
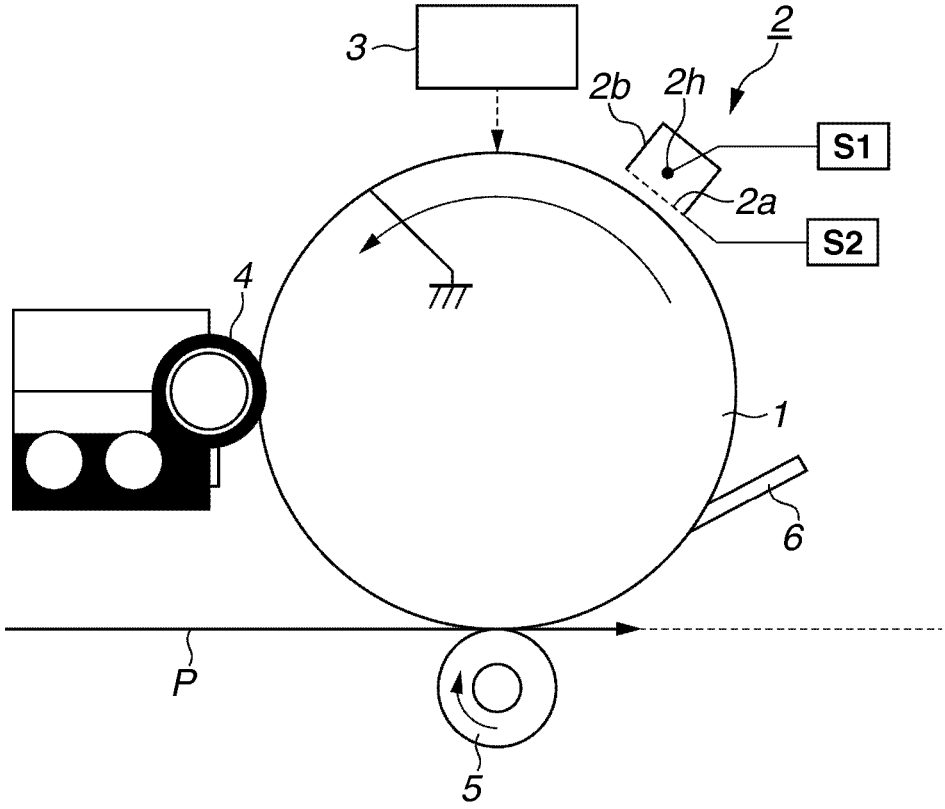
FIG. 1 is a schematic cross-sectional view illustrating an image forming apparatus according to a first exemplary embodiment of the present invention.

FIG. 1 illustrates a schematic configuration of an image forming apparatus according to a first exemplary embodiment of the present invention. A photosensitive drum 1, as an image bearing member of the present embodiment, includes a cylindrical (drum-type) electrophotographic photosensitive member. The photosensitive drum 1 has a diameter of 84 mm and rotates at a process speed (circumferential velocity) of 500 mm/sec around a central axis (not illustrated).

The charging device described in the present embodiment is a corona charger 2. The corona charger 2 includes a discharge wire as a discharge electrode as well as a grid electrode that increases the accuracy of electric potential adjustment. Further, each of the discharge wire and the grid electrode includes a cleaning member that cleans the matters attached thereto. Further, the corona charger 2 includes a shutter which covers an opening of a shield. Detailed configuration of the charging device will be described below.

The photosensitive drum 1, which has been charged by the corona charger, is irradiated by light emitted from a laser scanner as an exposure unit, and an electrostatic image is formed. The electrostatic image is developed by a development unit 4 as a developing unit that contains toner, and a toner image is formed. The toner image formed on the photosensitive drum 1 is transferred onto a recording material P at a nip portion (a transfer portion) between a transfer roller 5 as a transfer unit and the photosensitive drum 1. Residual transfer toner that remains on the image bearing member is removed by a cleaning blade 6 provided downstream of the transfer portion with respect to the rotation direction of the photosensitive drum 1.

The toner image formed on the recording material P is pinched and conveyed by a conveyance roller and thermally fixed by a fixing apparatus (not illustrated). Subsequently, the recording material P, which has undergone the fixing processing, is discharged from the apparatus.

Figure 2A:
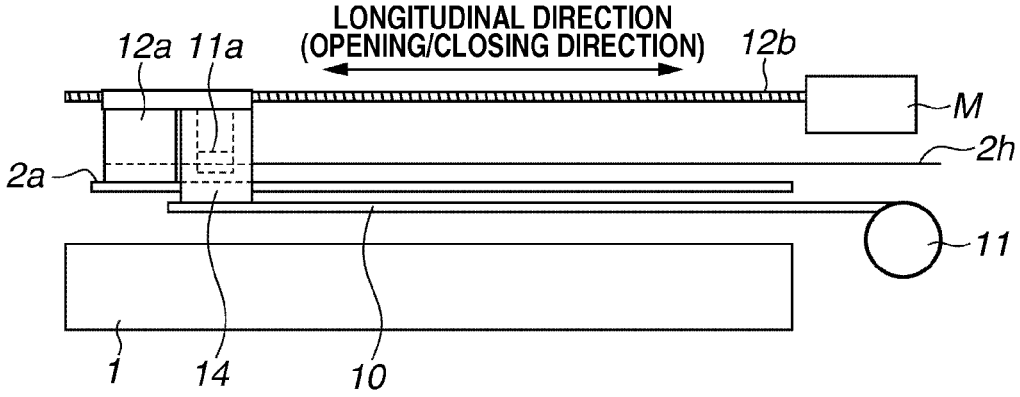
FIGS. 2A, 2B, and 2C illustrate a corona charger according to the first exemplary embodiment.
Figure 2B:
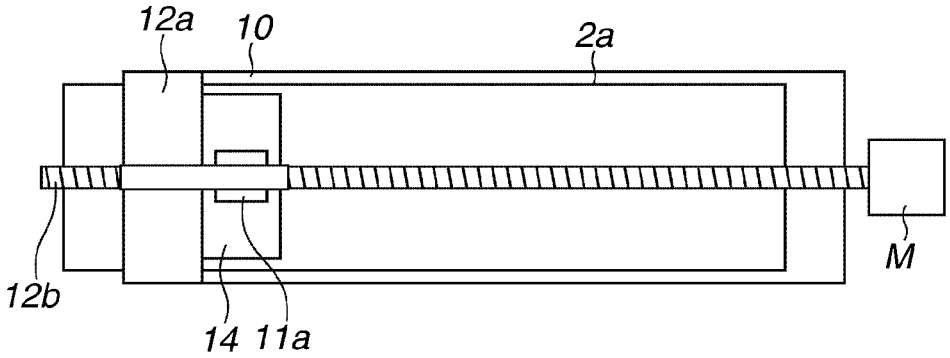
Figure 2C:
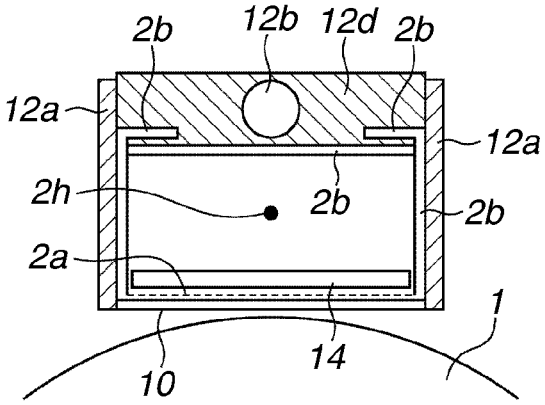
Figure 3A:
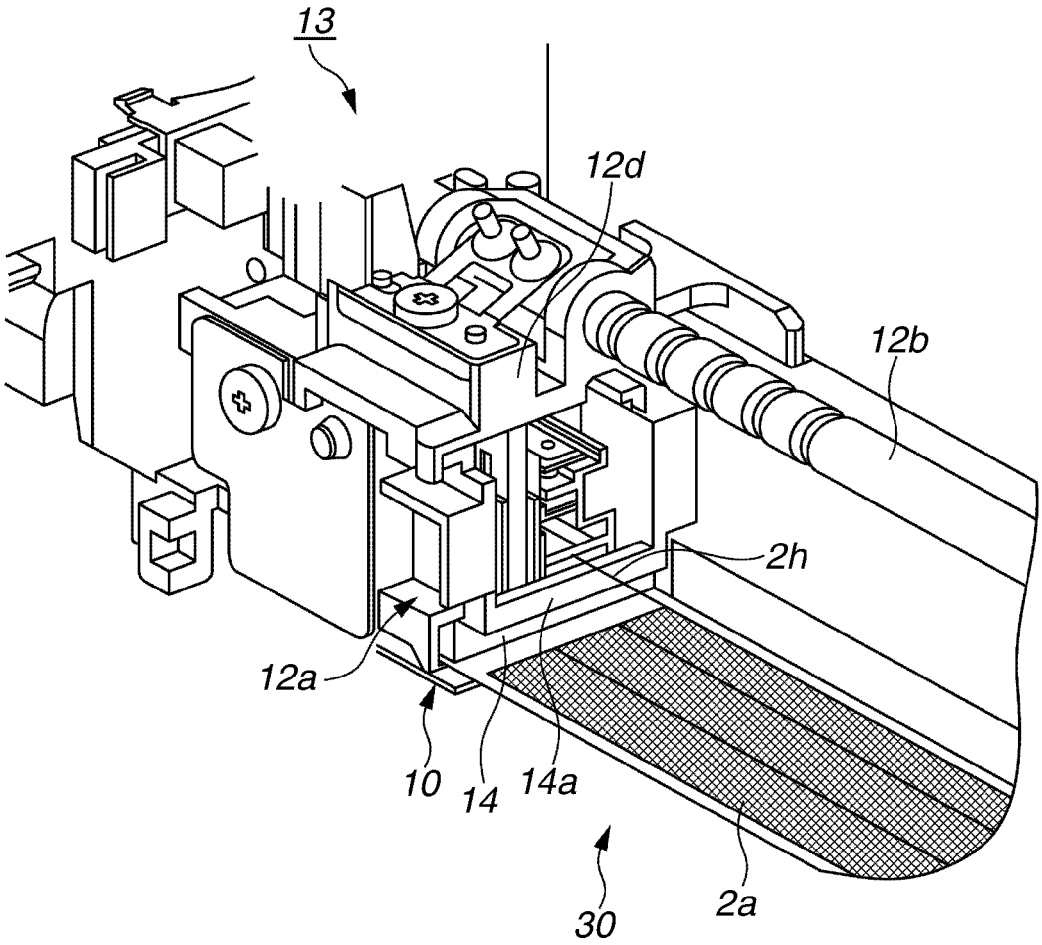
FIGS. 3A and 3B are perspective views illustrating the corona charger according to the first exemplary embodiment.

Next, the configuration of the charging device according to the present embodiment will be described in detail with reference to FIGS. 2A, 2B, and 2C. FIGS. 2A, 2B, and 2C are a side view, an overhead view, and a cross-sectional view illustrating the corona charger 2, respectively. Further, FIG. 3A is a perspective view illustrating the corona charger 2.

As illustrated in FIG. 2C, the corona charger 2 is a scorotoron type charger including a discharge wire 2*h*, a shield 2*b*, and a grid electrode 2*a*. The shield 2*b* is U-shaped, and is arranged around the discharge wire 2*h*. The grid electrode 2*a* is provided at an opening portion of the shield 2*b*. According to the present embodiment, a plate-like etching grid is used for the grid electrode 2*a*.

Further, high voltage is supplied to the discharge wire 2*h* of the corona charger 2 from a high-voltage power supply for discharge wire S1. Similarly, high voltage is supplied to the grid electrode 2*a* by a high-voltage power supply for grid electrode S2.

As is clear from the side view in FIG. 2A, the corona charger 2 is arranged to face the photosensitive drum 1 along its generating line, and the longitudinal direction of the corona charger 2 is substantially parallel to the axial direction of the photosensitive drum 1.

Next, the cleaning members of the corona charger 2 will be described. As illustrated in FIGS. 2A and 2B, the corona charger 2 of the present embodiment includes a cleaning pad 11*a* configured to clean the discharge wire 2*h* and a cleaning brush 14 as a cleaning member configured to clean the grid electrode 2*a*.

Figure 3B:
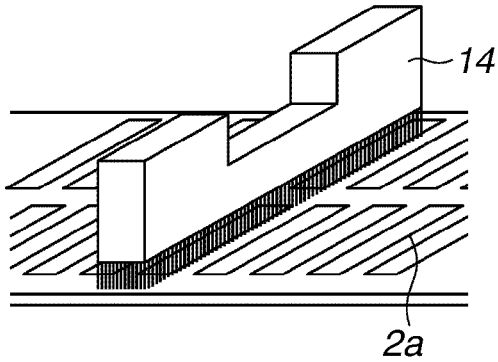

The cleaning pad 11*a* and the cleaning brush 14 move in the longitudinal direction of the corona charger 2 by a drive screw 12*b* that rotates according to the drive of a drive motor M. As illustrated in FIG. 3B, the cleaning brush 14 cleans the grid electrode 2*a* while contacting a discharge wire side of the grid electrode 2*a*.

According to the present embodiment, a sponge is used for the cleaning pad 11*a* as the wire cleaning member. The cleaning pad 11*a* holds the discharge wire 2*h* from both sides. An acrylic fiber woven into a ground fabric is used for the cleaning brush 14 as a grid cleaning member. Further, the acrylic fiber is treated with flame retardant treatment. In addition to acryl, materials such as nylon, polyvinyl chloride (PVC), and polyphenylene sulfide resin (PPS) may also be used for the cleaning brush. Further, the cleaning brush 14 is not limited to a brush, and a pad (elastic body) made of felt or sponge, or a sheet coated with an abrasive such as alumina or silicon carbide may also be used.

Further, the charging device of the present embodiment includes a charging device shutter 10 which is a sheet-type shutter that can cover/not cover (open/close) the opening of the corona charger 2. The width of the charging device shutter 10 in the widthwise direction is wider than the width of the corona charger 2 in the widthwise direction. Further, a rayon nonwoven fabric with a thickness of 30 μm is used for the charging device shutter 10 of the present exemplary embodiment. The charging device shutter 10, however, is not limited to such an example. A woven fabric from a nylon fiber, or a urethane or a polyester film, having a sheet form, may also be used. As is the case with the cleaning brush 14, the charging device shutter 10 is driven in the longitudinal direction of the corona charger 2 by the rotation of the drive screw 12*b* that holds the end of the shutter.

As illustrated in FIG. 2A, the cleaning pad 11*a*, the cleaning brush 14, and the charging device shutter 10 move in the longitudinal direction of the corona charger 2 in an integrated manner by the drive of the drive motor M. Further, a moving member 12*a* (a carriage), which moves while holding one end of the charging device shutter 10, is arranged such that the cleaning brush 14 and the cleaning pad 11*a* are covered by the charging device shutter 10 so as not to directly face the photosensitive drum 1. Furthermore, since the charging device shutter 10, the cleaning pad 11*a*, and the cleaning brush 14 are driven by one common motor, the number of drive sources (motors) is reduced. The charging device shutter 10 and others can move both in the opening direction and in the closing direction by switching the rotation of the drive of the drive motor M between the positive rotation and the negative rotation. Further, the moving speed of the carriage can be changed by changing the power supplied to the drive motor M.

According to the present embodiment, a force is applied to the charging device shutter 10 so that the shutter moves in the opening direction of the opening of the shutter by a winding roller as a winding member of the shutter. More precisely, the winding roller internally includes a power spring (not illustrated) as a force application component. By this power spring, a force is consistently applied in the clockwise direction (shutter closing direction) as in FIG. 2A.

The corona charger 2 includes a torque limiter (not illustrated), so as not to apply a force (tension) greater than a predetermined level to the charging device shutter 10.

According to this configuration, the winding roller can take up the charging device shutter 10 while preventing the shutter 10 from hanging down, when the opening of the corona charger 2 is closed by the charging device shutter 10.

Similarly, when the opening is covered by the charging device shutter 10 (i.e., in a closed state), the amount of force that does not move the charging device shutter 10 is applied to the charging device shutter 10, thereby preventing the charging device shutter 10 from hanging down. Thus, by applying tension to the charging device shutter 10 in the longitudinal direction of the corona charger 2, a state where corona products cannot easily escape outside through a gap between the charging device shutter 10 and the corona charger 2 can be maintained.

The opening/closing of the charging device shutter 10 and the cleaning sequence for the discharge wire and the grid electrode will be described with reference to the flowcharts in FIGS. 5A, 5B, 6A, 6B, and 7. First, a control device 300, which controls each unit of the image forming apparatus, will be described with reference to a block diagram in FIG. 4. Then, the control procedures will be described with reference to the flowcharts.

Figure 4:
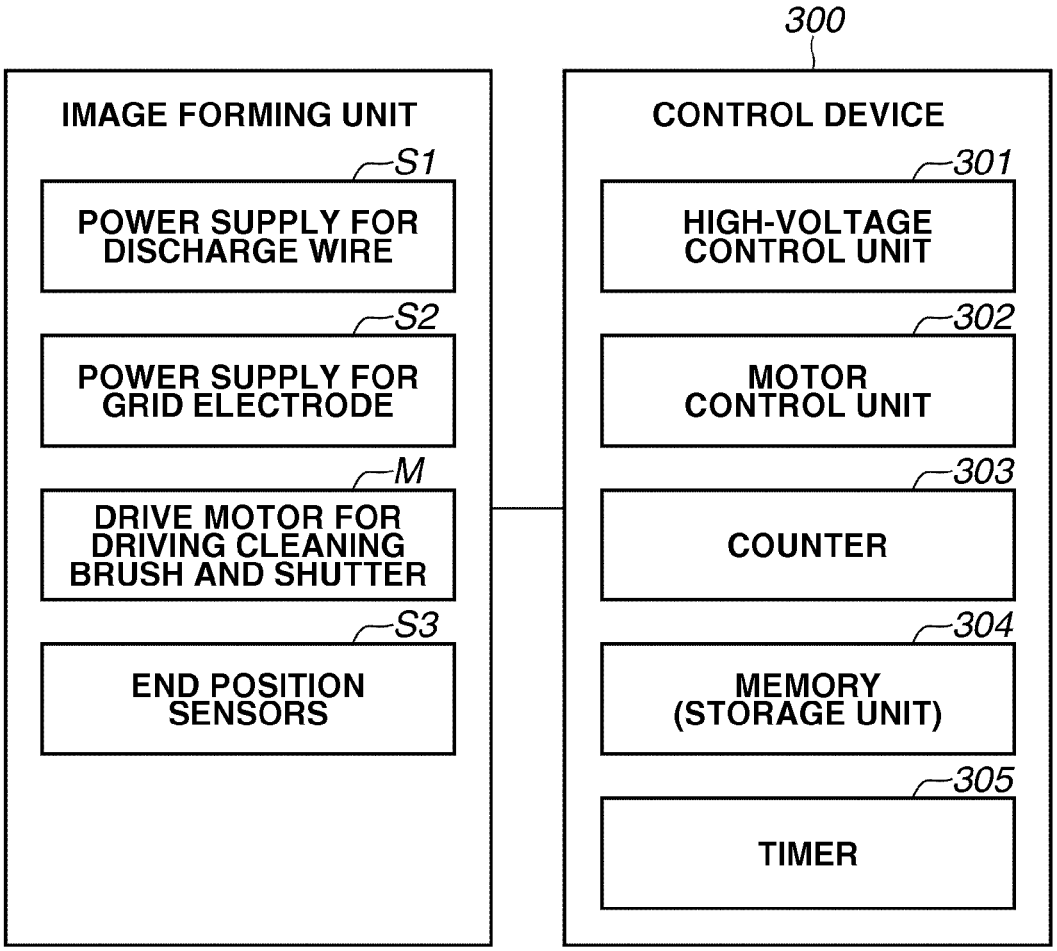
FIG. 4 is a control block diagram illustrating the image forming apparatus according to the first exemplary embodiment.

FIG. 4 is a control block diagram of the control device 300 according to the present embodiment. The control device 300 includes a high-voltage control unit 301, a motor control unit 302, a counter 303, a memory 304, and a timer 305. The control device 300 controls each unit in an image forming unit. More precisely, the high-voltage control unit 301 controls the high-voltage power supply for discharge wire S1 and the high-voltage power supply for grid electrode S2 to control the voltage to be applied and the power on/off operation. Similarly, the motor control unit 302 controls the drive motor M to control the rotational drive and rotate the drive screw 12*b*.

Additionally, the control device 300 includes the memory 304 as a storage unit. Each control unit controls a corresponding unit according to a program stored in the memory 304. Further, the control device 300 includes the counter 303 which counts the number of image-formed sheets. By referencing the count value of the counter 303, the control device 300 performs operations according to the condition. Furthermore, based on an output of the timer 305 that counts time, the opening/closing of the charging device shutter 10 is predicted.

Additionally, an end position sensor S3 can be provided at each end of the opening of the corona charger 2. If the end position sensor S3 is provided, whether the charging device shutter 10 is open/closed can be detected more accurately compared to a case where only the timer 305 is used. Further, the control device 300 can obtain information of whether the charging device shutter 10 is open/closed and the position of the cleaning brush based on the information output from the end position sensor S3.

Figure 5A:
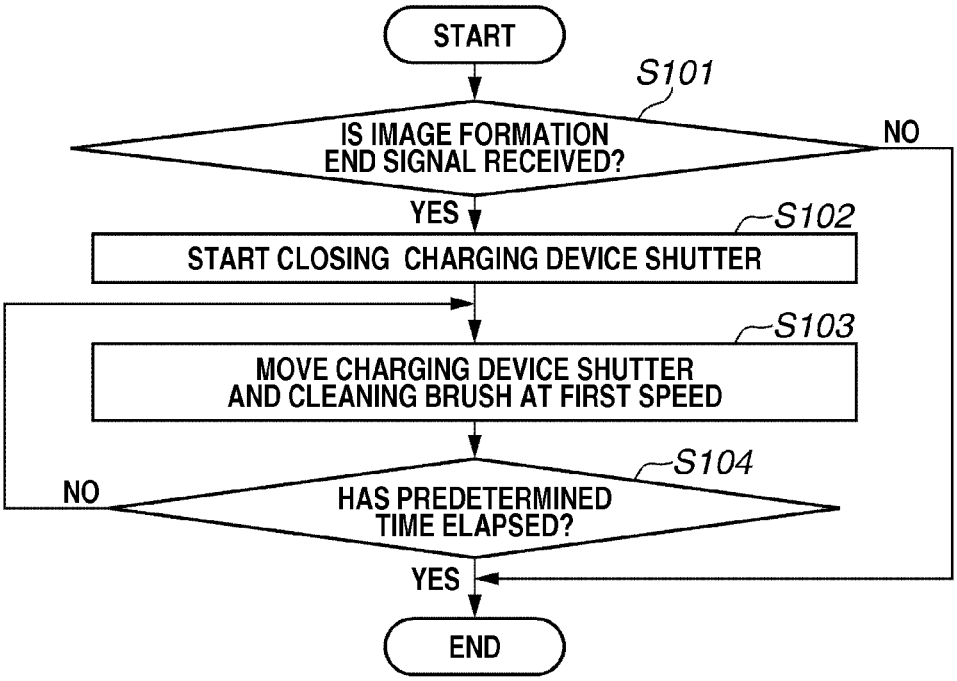
FIGS. 5A and 5B are flowcharts illustrating a closing operation of a charging device shutter according to the first exemplary embodiment.
Figure 5B:
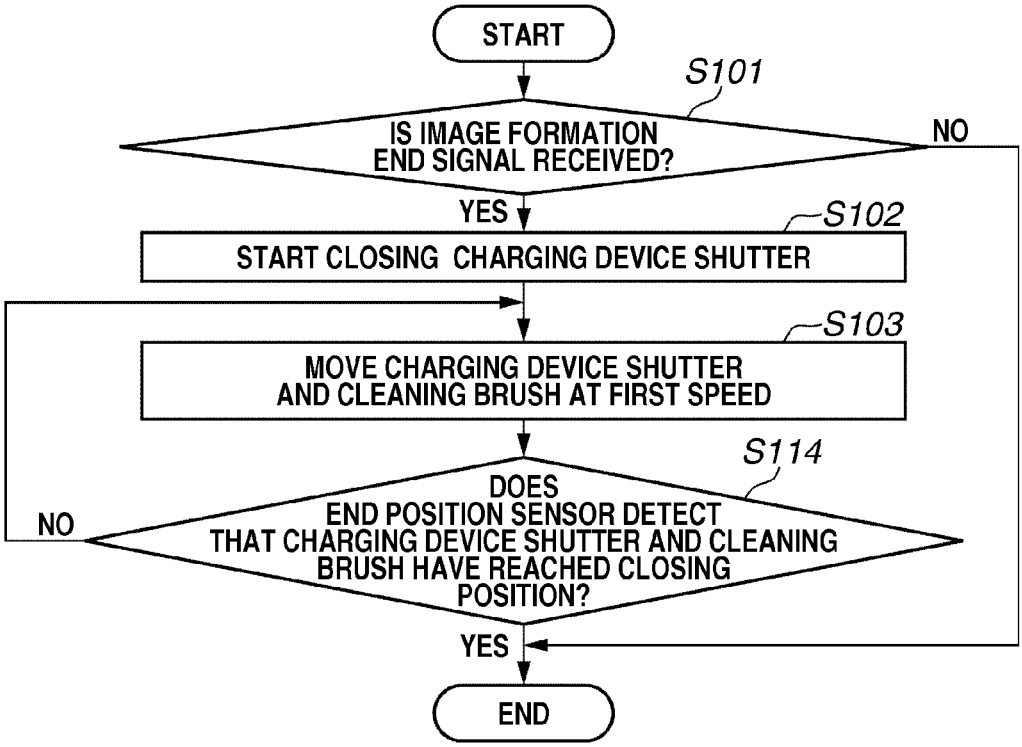
Figure 6A:
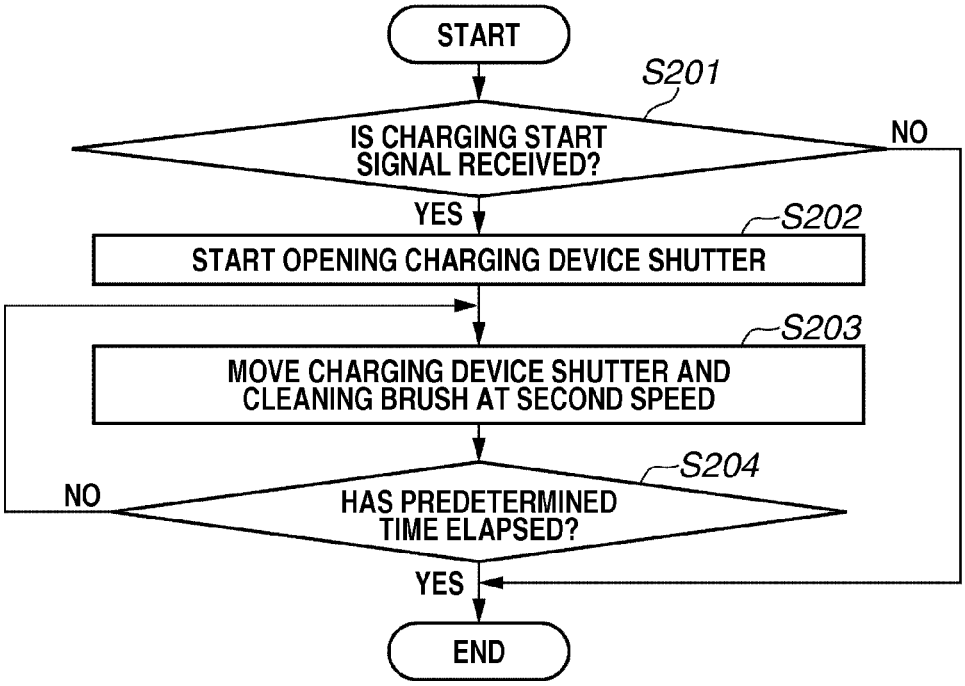
FIGS. 6A and 6B are flowcharts illustrating an opening operation of a charging device shutter according to the first exemplary embodiment.
Figure 6B:
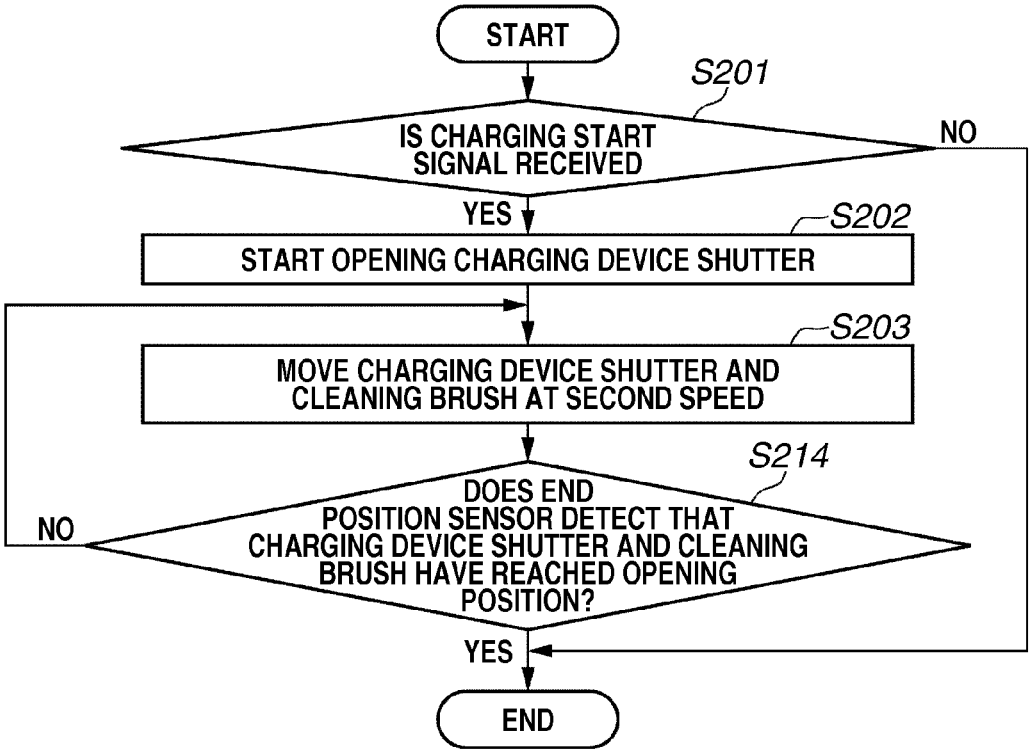

Next, the opening/closing sequence regarding the opening of the corona charger 2 by the charging device shutter 10 will be described with reference to flowcharts in FIGS. 5A, 5B, 6A, and 6B. FIGS. 5A and 5B are flowcharts illustrating the closing sequence and FIGS. 6A and 6B are flowcharts illustrating the opening sequence for the charging device shutter 10.

In recent years, in order to prevent corona products, which causes image deletion, from attaching to the photosensitive member there has been provided a configuration in which the opening of the corona charger is covered by a shutter when the image forming apparatus is in a sleep (OFF) state. If the shutter is closed, the image formation cannot be performed. Further, the rotation of the photosensitive drum necessary in adjusting various image forming conditions (adjustment operation) cannot be performed.

On the other hand, the user desires to obtain a printed sheet in a shorter time from when the power of the image forming apparatus is turned on. Thus, quick opening of the shutter is required. The opening/closing sequence for the charging device shutter 10 will now be described with reference to the flowcharts.

The closing sequence for the charging device shutter 10 will be described with reference to the flowchart illustrated in FIG. 5A. After the image formation is finished, if the opening of the corona charger is open for a long time, corona products may be attached to the photosensitive member. The attached corona products cause a defective image called image deletion due to moisture in the environment. In order to prevent the occurrence of such a defective image, the opening of the corona charger is controlled to be covered by the charging device shutter 10.

In step S101, the control device 300 determines whether the control device 300 has received a signal indicating the end of the image formation. If the control device 300 determines that the control device 300 has received such a signal (YES in step S101), the processing proceeds to step S102. If the control device 300 determines that the control device 300 has not yet received such a signal (NO in step S101), then the processing ends.

In step S102, the motor control unit 302 enables the drive motor M to start moving the charging device shutter 10 and the cleaning brush 14 in the closing direction of the opening of the corona charger 2. The charging device shutter can also be closed a predetermined period of time after the end of the image formation, according to the time counted by the timer 305. In other words, when a predetermined time (including 0 second) has elapsed after the end of the image formation, the control device 300 can start closing the charging device shutter 10. In step S103, the motor control unit 302 enables the drive motor M to move the charging device shutter 10 and the cleaning brush 14 at a first speed until they reach a position opposite a standby position. The position they reach is a shutter closed position at the left end of the illustration in FIG. 2A. In step S104, the motor control unit 302 determines whether a driving time that is set for the drive motor M and is stored in the memory 304 (the predetermined time is 5 seconds in the present embodiment) has elapsed. If the motor control unit 302 determines that the predetermined driving time has elapsed (YES in step S104), the motor control unit 302 stops the drive motor M, and then the closing sequence for the charging device shutter 10 ends. On the other hand, if the motor control unit 302 determines that the predetermined driving time has not yet elapsed (NO in step S104), the processing returns to step S103.

The detection of whether the closing of the charging device shutter 10 has been completed can be determined by providing the end position sensor S3 at the shutter closed position, which is a position opposite the standby position (shutter open position) of the charging device shutter 10. In this manner, whether the charging device shutter 10 is closed can be detected more reliably. This contributes to reducing operation time. A case where the end position sensor S3 is provided at the shutter closed position will be described with reference to the flowchart illustrated in FIG. 5B.

In step S103, the motor control unit 302 enables the drive motor M to move the charging device shutter 10 and the cleaning brush 14 at a first speed until they reach the position opposite the standby position (shutter closed position at the left end of the illustration in FIG. 2A). At this position opposite the standby position of the charging device shutter 10 and the cleaning rush 14, the end position sensor S3, which includes an optical sensor including a light-receiving unit and a light emitting unit, is provided. Further, a protrusion member which enters between the light-receiving unit and the light emitting unit is provided on the moving member 12*a* which moves while holding one end of the charging device shutter 10. If this protrusion member enters between the light-receiving unit and the light emitting unit of the optical sensor, the end position sensor S3 can detect that the charging device shutter 10 and the cleaning brush 14 have reached the position opposite the standby position. In step S114, the motor control unit 302 determines whether the end position sensor S3 has detected that the charging device shutter 10 and the cleaning brush 14 have reached the position opposite the standby position. If the motor control unit 302 determines that the charging device shutter 10 and the cleaning brush 14 have reached the position opposite the standby position (YES in step S114), the motor control unit 302 transmits a stop signal to the drive motor M, and the closing of the charging device shutter 10 ends. On the other hand, if the motor control unit 302 determines that the charging device shutter 10 and the cleaning brush 14 have not yet reached the position opposite the standby position (NO in step S114), then the processing returns to step S103.

Next, the opening of the charging device shutter 10 will be described with reference to the flowchart illustrated in FIG. 6A. If the charging device shutter 10 exists between the corona charger 2 and the photosensitive drum 1, the photosensitive drum 1 cannot be charged by the corona charger 2. Thus, before charging the photosensitive drum 1 (i.e., before performing the image formation), the charging device shutter is controlled to be opened by the control device 300.

In step S201, the control device 300 determines whether the control device 300 has received a signal (an image formation start signal) indicating the start of the charging. If the control device 300 determines that the control device 300 has received such a signal (YES in step S201), the processing proceeds to step S202. If the control device 300 determines that the control device 300 has not yet received such a signal (NO in step S201), then the processing ends. In step S202, on receiving the signal indicating the start of the charging, the motor control unit 302 enables the drive motor M to start moving the charging device shutter 10 and the cleaning brush 14 in the opening direction of the opening of the corona charger 2. In step S203, the motor control unit 302 enables the drive motor M to move the charging device shutter 10 and the cleaning brush 14 at a second speed, which is higher than the first speed, until they reach the standby position, which is the shutter open position at the right end of the illustration in FIG. 2A. In step S204, the motor control unit 302 determines whether a driving time that is set for the drive motor M and is stored in the memory 304 (the predetermined time is 4 seconds in the present embodiment) has elapsed. If the motor control unit 302 determines that the predetermined driving time has elapsed (YES in step S204), the motor control unit 302 sends a stop signal to the drive motor M. Then, the drive of the drive motor M is stopped and the opening sequence for the charging device shutter 10 ends. On the other hand, if the motor control unit 302 determines that the predetermined driving time has not yet elapsed (NO in step S204), the processing returns to step 203.

The operation for opening the charging device shutter 10 before the charging is started is described above according to the present embodiment. It is desirable to open the charging device shutter 10 before the rotation of the photosensitive drum 1. This is because, if the photosensitive drum 1 rotates in a state where the charging device shutter 10 is closed, the charging device shutter 10 may be caught in the photosensitive drum 1. In such a case, a surface flaw may be made on the photosensitive drum 1.

Further, according to the present embodiment, the time for driving the drive motor M is set and the drive motor M is stopped by a stop signal transferred to the drive motor M. However, by using an optical sensor, whether the charging device shutter 10 is open can be detected more reliably. This contributes to reducing operation time. A case where an optical sensor is used will be described with reference to the flowchart illustrated in FIG. 6B.

To be more precise, in step S203, the motor control unit 302 enables the drive motor M to move the charging device shutter 10 and the cleaning brush 14 at the second speed, which is higher than the first speed, until they reach the standby position, which is the shutter open position at the right end of the illustration in FIG. 2A. At the standby position of the charging device shutter 10 and the cleaning brush 14, there is provided an optical sensor including a light-receiving unit and a light emitting unit. Further, a protrusion member which enters between the light-receiving unit and the light emitting unit is provided on the moving member 12*a* which moves while holding one end of the charging device shutter 10. If this protrusion member enters between the light-receiving unit and the light emitting unit of the optical sensor, the optical sensor can detect that the charging device shutter 10 and the cleaning brush 14 have reached the standby position. In step S214, the motor control unit 302 determines whether the optical sensor has detected the charging device shutter 10 and the cleaning brush 14. If the motor control unit 302 determines that the charging device shutter 10 and the cleaning brush 14 have reached the standby position (YES in step S214), the motor control unit 302 transmits a stop signal to the drive motor M, and the opening of the charging device shutter 10 ends. On the other hand, the motor control unit 302 determines that the charging device shutter 10 and the cleaning brush 14 have not yet reached the standby position (NO in step S214), then the processing returns to step S203.

Figure 7:
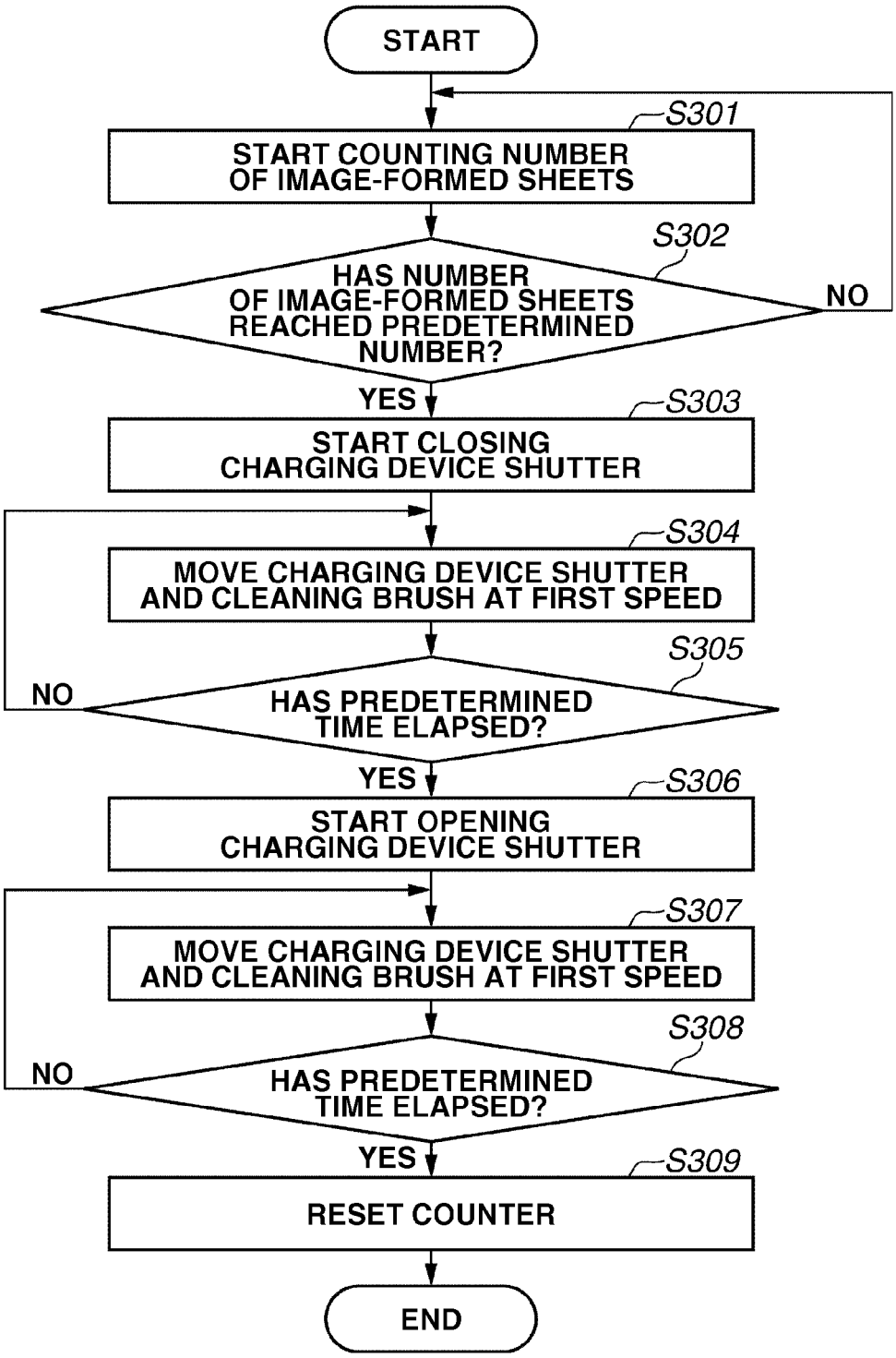
FIG. 7 is a flowchart illustrating a grid electrode cleaning operation according to the first exemplary embodiment.
Figure 8A:
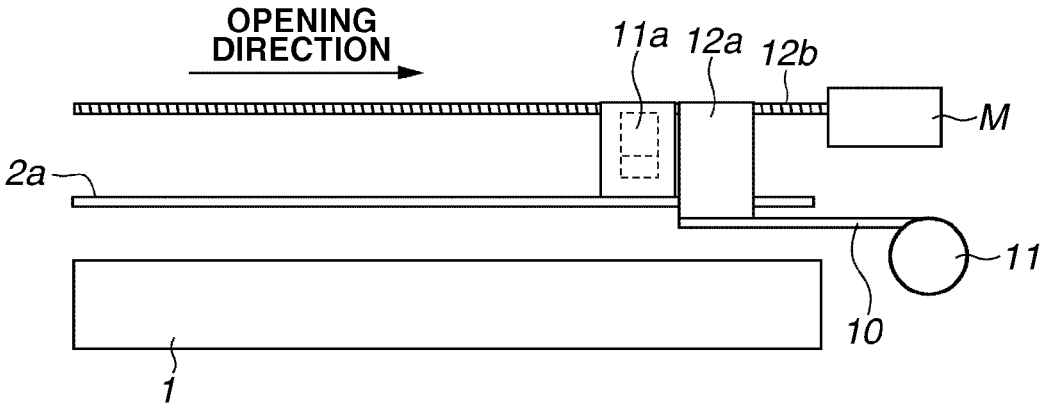
FIGS. 8A and 8B illustrate an opening/closing operation of the charging device shutter according to the first exemplary embodiment.
Figure 8B:
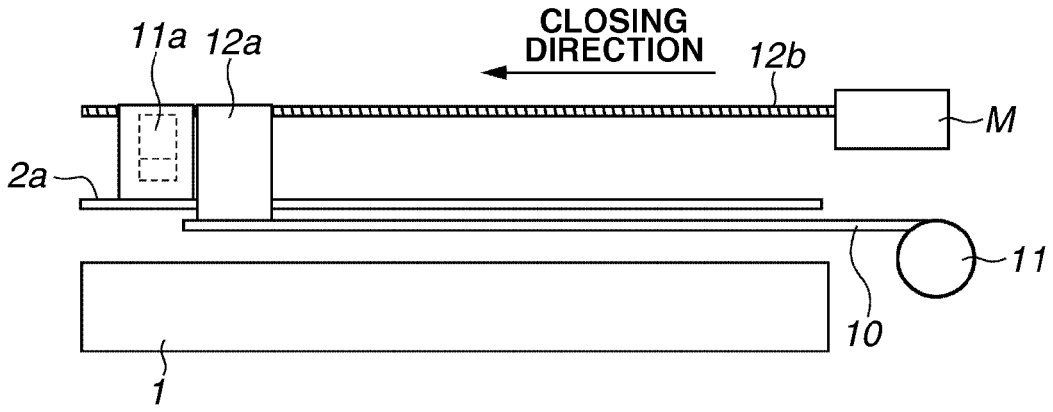

Next, a grid electrode cleaning operation will be described with reference to the flowchart illustrated in FIG. 7. According to the present embodiment, the cleaning brush 14 and the charging device shutter 10 are driven by a common drive motor (i.e., the drive motor M). Thus, the cleaning brush 14 moves in conjunction with the opening/closing of the above-described charging device shutter 10.

According to the present embodiment, the cleaning of the grid electrode is executed each time the image formation of a predetermined number of sheets is completed. In step S301, the counter 303 in the control device 300 counts the number of image-formed sheets. In step S302, the control device 300 determines whether the number of the image-formed sheets has reached a predetermined number stored in the memory 304 (1000 sheets according to the present embodiment). If the number of the image-formed sheets has reached the predetermined number (YES in step S302), the processing proceeds to step S303. In step S303, the motor control unit 302 enables the drive motor M to start moving the charging device shutter 10 and the cleaning brush 14 in the closing direction. In step S304, the motor control unit 302 enables the drive motor M to move the charging device shutter 10 and the cleaning brush 14 at the first speed until they reach the position opposite the standby position, which is the shutter closed position at the left end of the illustration in FIG. 2A.

As long as the speed of the cleaning brush 14 is appropriate for the cleaning of the grid electrode, the speed is not limited to the first speed. A different speed can be used so long as the speed is lower than the second speed.

In step S305, the motor control unit 302 determines whether a driving time that is set for the drive motor M and is stored in the memory 304 (the predetermined time is 5 seconds in the present embodiment) has elapsed. If the motor control unit 302 determines that the predetermined driving time has elapsed (YES in step S305), the motor control unit 302 transmits a stop signal to the drive motor M. The drive motor M that received the stop signal stops driving, and the closing of the charging device shutter 10 ends, and the processing proceeds to step S306. On the other hand, if the motor control unit 302 determines that the predetermined driving time has not yet elapsed (NO in step S305), the processing returns to step S304.

In step S306, the motor control unit 302 transmits a signal to the drive motor M that enables the drive motor M to rotate in the opposite direction to start opening the charging device shutter 10. In step S307, the motor control unit 302 enables the drive motor M to move the cleaning brush 14 and the charging device shutter 10 at the first speed until they reach the standby position (shutter open position). In step S308, the motor control unit 302 determines whether a driving time that is set for the drive motor M and is stored in the memory 304 (the predetermined time is 4 seconds in the present embodiment) has elapsed. If the motor control unit 302 determines that the predetermined driving time has elapsed (YES in step S308), the motor control unit 302 sends a stop signal to the drive motor M. Then, the drive of the drive motor M is stopped and the opening of the charging device shutter 10 ends, and the processing proceeds to step S309. On the other hand, if the motor control unit 302 determines that the predetermined driving time has not yet elapsed (NO in step S308), the processing returns to step 307. Although the drive motor M is controlled based on the period of time according to the present embodiment, the drive motor M can also be controlled based on an output from the end position sensor S3. In step S309, the count data, which indicates the number of the image-formed sheets counted by the counter 303 in the control device 300, is reset, and then the processing ends.

According to the above-described sequence, the occurrence of the defective charging due to attachment of foreign matters to the grid electrode during the image formation can be reduced. Accordingly, high-quality images can be obtained for a long period of time. In addition to the above-described cleaning of the grid electrode, since the cleaning member of the discharge wire moves together with the cleaning brush, the cleaning of the wire is also performed. Thus, the occurrence of defective charging due to the unclean wire can also be reduced.

Further, according to the present embodiment, the drive motor M is stopped when receiving a stop signal based on a predetermined driving time set for the drive motor M. However, an optical sensor can also be used for controlling the drive motor M. If the optical sensor is used, whether the charging device shutter is opened can be detected more reliably. This contributes to reducing operation time.

As illustrated in FIG. 2A, the position of the charging device shutter 10 is extremely close to the photosensitive drum 1. Thus, if the photosensitive drum 1 rotates while the charging device shutter 10 is closed, the charging device shutter 10 may be dragged by the drum when the drum rotates and may be damaged. Thus, the rotation of the photosensitive drum 1 cannot be started until the charging device shutter 10 is completely opened.

On the other hand, when the main body is powered off or the operation of the main body is stopped for a long time, the charging device shutter 10 is closed to prevent the image deletion. When the main body is powered on or when the operation of the main body is started again, the opening of the charging device shutter 10 is started. Subsequently, the image control processing is started. The rotation of the photosensitive drum 1 is started after the charging device shutter 10 is completely opened.

Under such conditions, other operations cannot be performed until the charging device shutter 10 is opened. As a result, a longer time is required until the output preparation can be started.

Thus, when the charging device shutter 10 is opened from the closed state in step S203, the number of rotations of the drive motor M is increased, and the number of rotations of a rotation member 13 is increased. Accordingly, the moving member 12*a* is driven at the second speed higher than the first speed. If the drive motor M includes a direct-current (DC) motor, 12 volts is applied to the DC motor when the wire is cleaned (at the first speed) and 24 volts is applied to the DC motor only when the shutter is opened (at the second speed). In this manner, the opening time of the shutter can be reduced from 10 to 5 seconds.

The speed of the cleaning brush moving in both the closing and opening directions can be set to 5 seconds. However, if the cleaning brush is driven at a high speed, the brush tends to wear out easily or the grid electrode may not be sufficiently cleaned. Thus, according to the present embodiment, the cleaning brush is driven at the second speed only when the shutter is driven in the opening direction, to enable the image formation after the image forming apparatus is powered on.

As described above, when the moving speed of the cleaning brush is increased, as illustrated in FIG. 3B, a fiber of the cleaning brush 14 may be caught in a gap between the grid electrodes and may be torn or fall off. If the torn fiber remains in the grid, defective charging may occur. Further, the torn fiber may enter the developing unit and a defective image due to, for example, defective developer coating may occur.

Figure 9A:
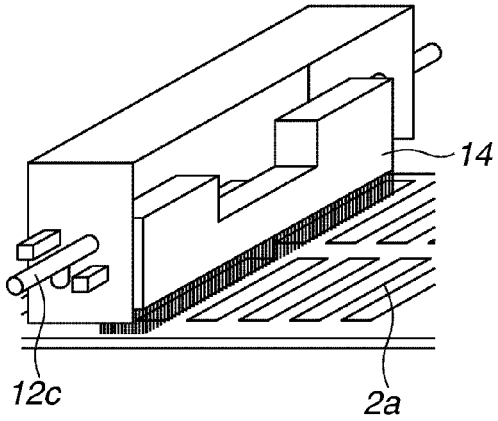
FIGS. 9A, 9B, and 9C illustrate a swing mechanism of a cleaning brush according to the first exemplary embodiment.
Figure 9B:
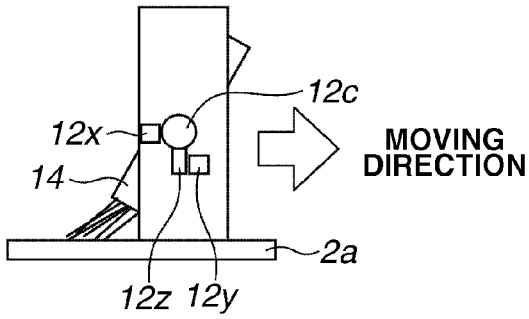

Thus, as illustrated in FIG. 9A, the present embodiment of the present invention has a swing shaft provided in the direction perpendicular to the moving direction of the cleaning brush 14. The swing shaft movably supports the cleaning brush 14 as a grid electrode cleaning member in the moving direction. As illustrated in FIG. 9B, the fiber of the cleaning brush is slanted according to the swing of the cleaning brush 14 in the moving direction, and the fiber is less likely to be caught in the gap between the grid electrodes. Thus, a defective image generated due to a fallen or a torn fiber can be reduced.

Figure 9C:
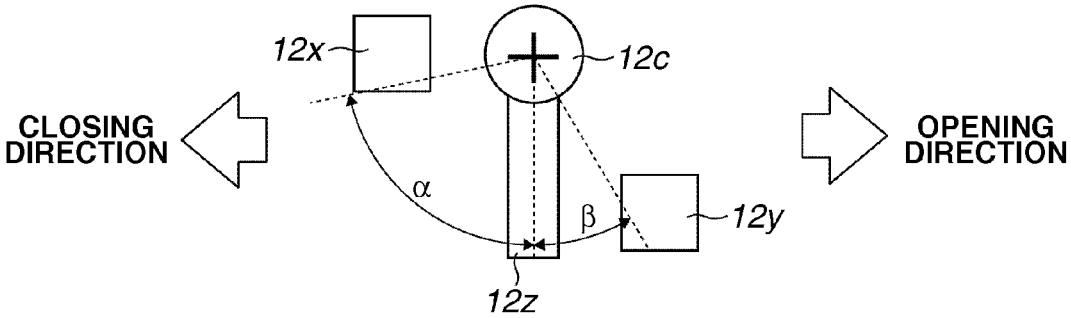

Next, the swing mechanism will be described in detail with reference to FIG. 9C. The cleaning brush 14 is rotatable about a shaft 12*c*. On the shaft 12*c*, there is provided a pin 12*z* which limits the rotation of the shaft. The pin 12*z* contacts regulation blocks 12*x* and 12*y* which serves as a limiting unit that limits the rotation angle of the shaft 12*c*, so that the shaft does not rotate greater than a predetermined angle. This limits the movement of the cleaning brush 14 to prevent the cleaning brush from moving excessively. As described above, when the state of the image forming apparatus is changed from the sleep state to the image formation state, the cleaning brush is controlled to move at the second speed higher than the first speed. Thus, when the shutter is driven in the closing direction, the cleaning of the grid electrode is prioritized over the protection of the fibers of the cleaning brush. Thus, the regulation blocks 12*x* and 12*y* are provided in such positions that the movable angle of the cleaning brush 14 when the brush moves in the shutter closing direction (angle $\alpha$ in FIG. 9C) is greater than the movable angle of the cleaning brush 14 when the brush moves in the shutter opening direction (angle β in FIG. 9C). In other words, the maximum swing angle of the cleaning brush 14 when the brush swings in the opening direction of the opening of the corona charger 2 from a position where the cleaning brush contacts the grid electrode at the closest position is smaller than the maximum swing angle of the cleaning brush 14 when the brush swings in the closing direction of the opening of the corona charger. According to the present embodiment, the maximum swing angle of the cleaning brush 14 is changed depending on the swing direction. Thus, regarding the frictional force generated when the cleaning brush 14 cleans the grid electrode, the frictional force generated when the cleaning brush moves in the closing direction of the opening of the corona charger 2 is greater than the frictional force generated when the cleaning brush moves in the opening direction of the opening of the corona charger 2. As a result, the cleaning ability of the cleaning brush 14 can be increased when the brush moves in the opening direction of the opening of the corona charger, compared to when the brush moves in the closing direction of the opening of the corona charger.

The increase in speed only when the shutter is opened is described above. However, since the cleaning brush 14 is also swingable when the charging device shutter 10 moves in the closing direction, the cleaning brush 14 can also move at a higher speed when the charging device shutter 10 is closed. If the cleaning brush 14 is supported in a swingable manner, the possibility of tearing a fiber can be reduced, but the cleaning brush 14 is unable to keep good contact with the grid electrode, and a positional relation suitable for the cleaning may not be maintained. Thus, by an arrangement of the regulation block 12*y*, the cleaning brush 14 may be supported in a swingable manner when the charging device shutter 10 moves from the closing position to the opening direction, and supported in a non-swingable manner when the charging device shutter 10 moves from the opening position to the closing direction.

According to the mechanism that enables the cleaning brush 14 that cleans the grid electrode to swing, the force required to continuously move the cleaning brush 14, which is in contact with the grid electrode, at a constant speed (a predetermined speed) in the closing direction and the force required to continuously move the cleaning brush 14, which is in contact with the grid electrode, at a constant speed (a predetermined speed equal to the speed in the closing direction) in the opening direction are different. More precisely, in continuously moving the cleaning brush 14, which is in contact with the grid electrode, in the opening direction at a constant speed, the cleaning brush 14 swings greatly, and the cleaning brush can be moved more easily compared to a case where the cleaning brush does not swing. In other words, since the cleaning brush 14 swings greatly, the fiber of the cleaning brush is less likely to be caught in the gap between the grid electrodes. This can prevent the cleaning brush from wearing out even if the moving speed of the cleaning brush is increased.

There were performed experiments to check whether a defective image is generated with configurations including/not including a swing shaft in the direction perpendicular to the moving direction of the cleaning brush. The experiments were performed by moving the cleaning brush in a reciprocating manner, and thereafter the presence/absence of the defective image was checked. The experiments were repeatedly performed until a defective image was generated. The result shows that, compared to the conventional cleaning brush which does not swing, the swingable cleaning brush according to the present invention has twice or more than twice the ability to withstand repeated operations.

Thus, even if the moving speed of the charging device shutter is increased, the defective image generated due to a fallen or torn fiber of the cleaning brush can be prevented.

By employing the mechanism which supports the cleaning brush in a swingable manner in both the opening/closing directions, not only the opening speed but also the closing speed of the shutter can be increased and the convenience of the user can be enhanced.

A second exemplary embodiment of the present invention will be described. Components similar to those of the first exemplary embodiment are denoted by the same reference numerals and their descriptions are not repeated.

As described in the first exemplary embodiment, when the cleaning brush 14 swings in the moving direction, the fiber of the cleaning brush 14 is slanted, thus reducing the possibility that the fiber falls off or is torn. However, the configuration of the cleaning brush described in the first exemplary embodiment becomes complex.

Figure 10A:
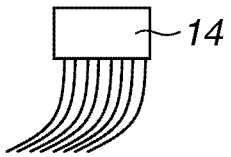
FIGS. 10A, 10B, and 10C illustrate a cleaning brush with slanted fibers according to a second exemplary embodiment of the present invention.
Figure 10B:
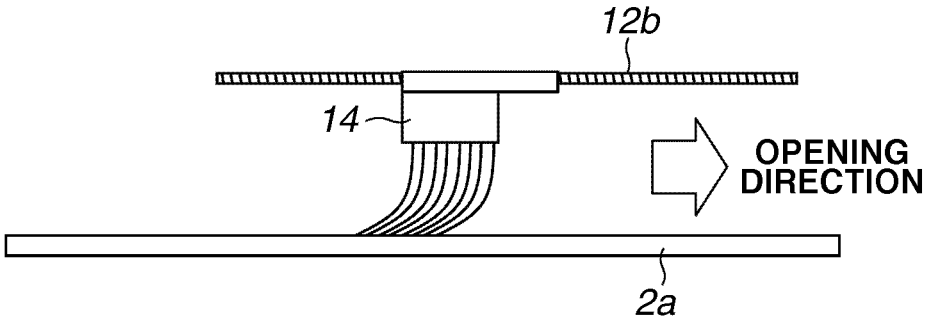

According to the present embodiment, as illustrated in FIG. 10A, the fiber of the cleaning brush is slanted when the brush is not in contact with the grid electrode. When this cleaning brush is set, as illustrated in FIG. 10B, the end of the fiber of the cleaning brush faces the direction opposite the opening direction of the shutter.

If such a cleaning brush is used, the occurrence of a defective image due to a fallen or torn fiber is reduced while maintaining the closing speed but increasing the opening speed of the shutter.

Figure 10C:
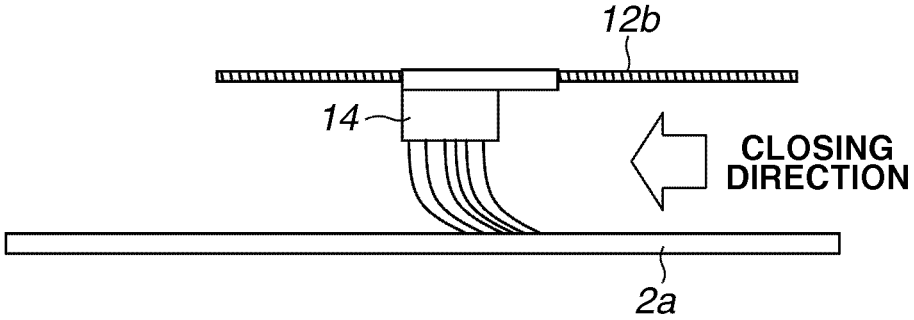

FIG. 10C illustrates a state of the cleaning brush treated with fiber slanting treatment when the brush is driven in the closing direction of the shutter. Even if the cleaning brush has slanted fibers, when the shutter moves in the closing direction, the direction of the slanting of the fibers of the cleaning brush is changed from the original direction to the opposite direction due to the grid electrode 2*a*. At this time, the pressure between the brush and the grid electrode is increased and the sliding frictional force against the grid electrode is also increased. Accordingly, the cleaning ability of the cleaning brush with respect to the grid electrode is increased. Further, regarding the fallen or torn fiber, since the moving speed of the cleaning brush is slow, the load when the fiber is caught in the gap between the grid electrodes will be small. Accordingly, defective images are less likely to be generated.

Thus, even if the moving speed in the opening direction of the shutter is increased, defective images that may be generated due to a fallen or torn fiber of the cleaning brush can be prevented. Further, since at least the opening speed of the shutter can be increased, the convenience of the user can be enhanced.

By treating the cleaning brush with fiber slanting treatment, the force required in continuously moving the cleaning brush, which is in contact with the grid electrode, in the opening direction of the shutter at a constant speed (a predetermined speed) can be reduced compared to the force required in continuously moving the cleaning brush, which is in contact with the grid electrode, at a constant speed (a predetermined speed equal to the speed in the closing direction). In other words, regarding the frictional force generated between the cleaning brush and the grid electrode when the cleaning brush cleans the grid electrode, the frictional force generated when the cleaning brush moves in the closing direction of the opening of the corona charger is greater than the frictional force that occurs when the cleaning brush moves in the opening direction of the opening of the corona charger.

As a result, the cleaning ability can be increased when the cleaning brush moves in the closing direction of the opening of the corona charger compared to when the cleaning brush moves in the opening direction of the opening of the corona charger.

According to the present embodiment, the fiber of the cleaning brush is made of, for example, nylon, and is slanted by heat treatment. However, the fiber slanting treatment of the cleaning brush is not limited to the heat treatment, and a different method can be selected according to the material of the fiber used for the cleaning brush.

In a configuration where a closed charging device shutter is opened to enhance the convenience of the user, if the friction between the grid electrode and the cleaning brush that cleans the grid electrode is increased, fuzz or the like that falls off from the cleaning member causes defective charging. Thus, when the charging device shutter is driven from the closed state to the open state at the second speed, the friction resistance can be reduced by separating the cleaning brush from the grid electrode or reducing the force applied to the grid electrode by the cleaning brush.

The cleaning brush is used as an example of the cleaning member. The present invention can be applied to a pad that cleans the grid electrode as the cleaning member. If a cleaning pad is used, the pad needs to undergo surface treatment in advance, so that the slide resistance can have a magnitude relation depending on the moving directions.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-224936 filed Oct. 12, 2011, which is hereby incorporated by reference herein in its entirety.

What is claimed is:

1. A charging device for charging an object comprising:

a corona charger including, a charging electrode and a grid electrode having a plurality of holes and arranged to an opening formed nearer to the object than the charging electrode;

a cleaning brush configured to clean the grid electrode;

a sheet-type shutter configured to open and close the opening of the corona charger;

a screw configured to hold the cleaning brush and the shutter; and a drive source configured to drive both the cleaning brush and the shutter by rotating the screw in a longitudinal direction of the corona charger, wherein the drive source rotates the screw so that a moving speed of the shutter in opening direction to be faster than that in closing direction, and wherein the cleaning brush is swingably supported by centering around a swing shaft that is parallel to a width direction of the corona charger which is in the direction perpendicular to the moving direction of the cleaning brush;

a first limiting unit configured to limit angle $\alpha$, that is a movable angle of the cleaning brush from a position that the cleaning brush overlapping from the swing shaft to a perpendicular line of the grid electrode, to a position that the cleaning brush moving downstream in a closing direction of the shutter; and a second limiting unit configured to limit angle $\beta$, that is a movable angle of the cleaning brush from a position that the cleaning brush overlapping from the swing shaft to the perpendicular line of the grid electrode, to a position that the cleaning brush moving downstream in an opening direction of the shutter, wherein the angle $\alpha$ is wider than the angle $\beta$.

2. A charging device for charging an object comprising;

a corona charger including, a charging electrode and a grid electrode having a plurality of holes and arranged to an opening formed nearer to object than the charging electrode;

a cleaning brush configured to clean the grid electrode;

a sheet-type shutter configured to open and close the opening of the corona charger; and a screw configured to hold the cleaning brush and the shutter; and a drive source configured to drive both the cleaning brush and the shutter by rotating the screw in a longitudinal direction of the corona charger, wherein a fiber of the cleaning brush contacting the grid electrode is treated with fiber slanting treatment such that the brush member is slanted in downstream of a direction that the shutter moves when closing the opening.

3. The charging device according to claim 1, wherein the cleaning brush includes a brush portion having a plurality of fibers and a holder configured to hold the brush portion, and wherein the condition that the cleaning brush is at a position where overlapping from the swing shaft to a perpendicular line to the grid electrode denotes a condition that a straight line between a central portion along the moving direction of the cleaning brush at an end portion where the brush portion is held by the holder, and the swing shaft, overlapping the perpendicular line.

* * * * *